US007224933B2

(12) United States Patent
Mochizuki et al.

(10) Patent No.: US 7,224,933 B2
(45) Date of Patent: May 29, 2007

(54) SHEET FINISHING APPARATUS AND IMAGE FORMING APPARATUS

(75) Inventors: Naoto Mochizuki, Fuefuki (JP); Yosuke Sajiki, Kofu (JP)

(73) Assignee: Nisca Corporation, Minamikoma-Gun, Yamanashi-Ken (JP)

( * ) Notice: Subject to any disclaimer, the term of this patent is extended or adjusted under 35 U.S.C. 154(b) by 76 days.

(21) Appl. No.: 11/000,947

(22) Filed: Dec. 2, 2004

(65) Prior Publication Data

US 2005/0123332 A1 Jun. 9, 2005

(30) Foreign Application Priority Data

Dec. 3, 2003 (JP) ..... 2003-404863

(51) Int. Cl.
*G03G 15/00* (2006.01)

(52) U.S. Cl. ..... 399/410; 399/407

(58) Field of Classification Search ..... 399/405, 399/407, 408, 410; 270/58.07–58
See application file for complete search history.

(56) References Cited

U.S. PATENT DOCUMENTS 5,060,921 A * 10/1991 Higashio et al. ..... 270/58.09
5,144,562 A * 9/1992 Stikkelorum et al. ..... 700/223
5,980,676 A * 11/1999 Meetze ..... 156/216
5,999,244 A * 12/1999 Yanagihara et al. ..... 355/53
6,406,199 B1 * 6/2002 Hayashi ..... 400/76
6,549,299 B1 * 4/2003 Allen et al. ..... 358/1.18
6,733,006 B2 * 5/2004 Kobayashi et al. ..... 270/37

* cited by examiner

*Primary Examiner*—Anthony H. Nguyen
(74) *Attorney, Agent, or Firm*—Manabu Kanesaka

(57) ABSTRACT

A sheet finishing apparatus includes a transfer device for transferring sheets having toner images, a sheet bundling device for bundling the sheets transferred from the transfer device, and a stapling device for driving a staple into the sheets at a stapling position where the toner images are formed to staple the sheets.

14 Claims, 11 Drawing Sheets

SHEET FINISHING APPARATUS AND IMAGE FORMING APPARATUS

BACKGROUND OF THE INVENTION AND RELATED ART STATEMENT

The present invention relates to a sheet finishing apparatus and an image forming apparatus, particularly to a sheet finishing apparatus for bundling sheets with images and stapling a sheet bundle and an image forming apparatus provided with the sheet finishing apparatus.

Conventionally, there has been a sheet finishing apparatus for aligning, bundling and stapling sheets with images ejected from an image forming apparatus such as a copying machine, a printer, a facsimile or the like (refer to Japanese Patent Publications (Kokai) No. 2000-72320 and No. 2003-267622). In such a sheet finishing apparatus, the sheets are ejected in a bundle with ends thereof aligned and stapled in uniform format. Accordingly, it is possible to eliminate manual processing such as manual aligning and manual stapling. Such a sheet finishing apparatus is provided with a stapler unit for driving a staple into the sheet bundle. In general, a stapler unit has a maximum stapling capacity such as 20 sheets or 30 sheets, and is designated with a grade and power consumption according to the capacity.

In the conventional sheet finishing apparatus, when a large number of sheets are stapled, it is necessary to increase a load of a staple for penetrating a sheet bundle, thereby causing a problem such that legs of a staple are bent or broken. Such a problem may be associated with low rigidity of a staple or a thickness of a sheet (especially, a cover sheet).

In view of the problems described above, an object of the present invention is to provide a sheet finishing apparatus capable of surely stapling a large number of sheets without deforming a staple, and an image forming apparatus provided with the sheet finishing apparatus.

Further objects and advantages of the invention will be apparent from the following description of the invention.

SUMMARY OF THE INVENTION

In order to attain the objects described above, according to a first aspect of the present invention, a sheet finishing apparatus comprises a sheet transfer device for transferring sheets with toner images, a sheet bundling device for bundling the sheets transferred by the sheet transfer device, and a stapling device for driving a staple into the sheets at a position where the toner images is formed to staple the sheets bundled by the sheet bundling device.

In the first aspect of the present invention, the sheets having the toner images are transferred by the sheet transfer device. The sheets transferred by the sheet transfer device are bundled by the sheet bundling device. The sheets bundled by the sheet bundling device are stapled when the staples are driven into the bundle at the position where the toner images are formed. A load of the staple driven into the sheet at the position with the toner images is smaller than a load of the staple driven into the sheet at a position without the toner images as the number of the sheets increases. Although a reason for the decrease in the load is not clear at this moment, it is confirmed that the load becomes small under different environmental conditions.

In the first aspect of the present invention, the stapling device staples the sheet bundled by the sheet bundling device at the position with the toner images, thereby decreasing the load of the staple as compared with the case of stapling the sheet bundle at a position without the toner images. Accordingly, it is possible to surely staple a large number of the sheets without deforming the staple. The toner image may be formed at a position including a stapling position in a strip form or a separate form.

In the first aspect of the present invention, the sheet finishing apparatus may further comprise a transport device for moving one of the sheets bundled by the sheet bundling device and the stapling device relative to each other, and a control device for controlling the stapling device so as to drive the staple at the position with the toner images. Further, the stapling device may be arranged so as to drive the staple from a backside of the sheets at a position where the toner images are formed.

According to a second aspect of the present invention, an image forming apparatus comprises a sheet feeding device for feeding sheets, an image forming device for forming toner images on the sheets fed from the sheet feeding device, a sheet transfer device for transferring the sheets with the toner images formed by the image forming device, a sheet bundling device for bundling the sheets transferred by the sheet transfer device, and a stapling device for driving a staple into the sheets at a position there the toner images are formed to staple the sheets bundled by the sheet bundling device.

In the second aspect of the present invention, the sheets are supplied by the sheet feeding device. The image forming device forms the toner images on the sheets supplied by the sheet feeding device. The sheets with the toner images formed by the image forming device are transferred by the sheet transfer device. The sheets transferred by the sheet transfer device are bundled by the sheet bundling device. The stapling device staples the sheets bundled by the sheet bundling device at a position with the toner images.

In the second aspect of the present invention, the image forming apparatus may further comprise a transport device for transporting one of the sheets bundled by the sheet bundling device and the stapling device relative to each other, and a control device for controlling the transport device so that the stapling device drives the staple into the sheets at a position with the toner images. The image forming apparatus may further comprise a positioning device for determining a stapling position where the stapling device drives the staple, and an image control device for controlling the image forming device to form the toner images at a position including the stapling position.

In the second aspect of the present invention, when the positioning device determines a plurality of stapling positions, the image control device controls the image forming device to separately form the toner images at positions corresponding to the stapling positions or ends of the staple, thereby minimizing an amount of toner. Further, the image control device may control the image forming device to form the toner images on a front surface of the sheet opposite to a back surface where the stapling device drives the staple and the stapling device drives the staple from the backside. Accordingly, the front surface of the sheet, especially a cover sheet, does not have the toner images, thereby improving appearance of the sheet bundle.

According to the present invention, the stapling device drives the staple into the sheet bundle formed by the sheet bundling device at a position with the toner images, thereby reducing a load of the staple. Accordingly, it is possible to surely staple a large number of the sheets without deforming the staple.

DETAILED DESCRIPTION OF PREFERRED EMBODIMENTS

Figure 1:
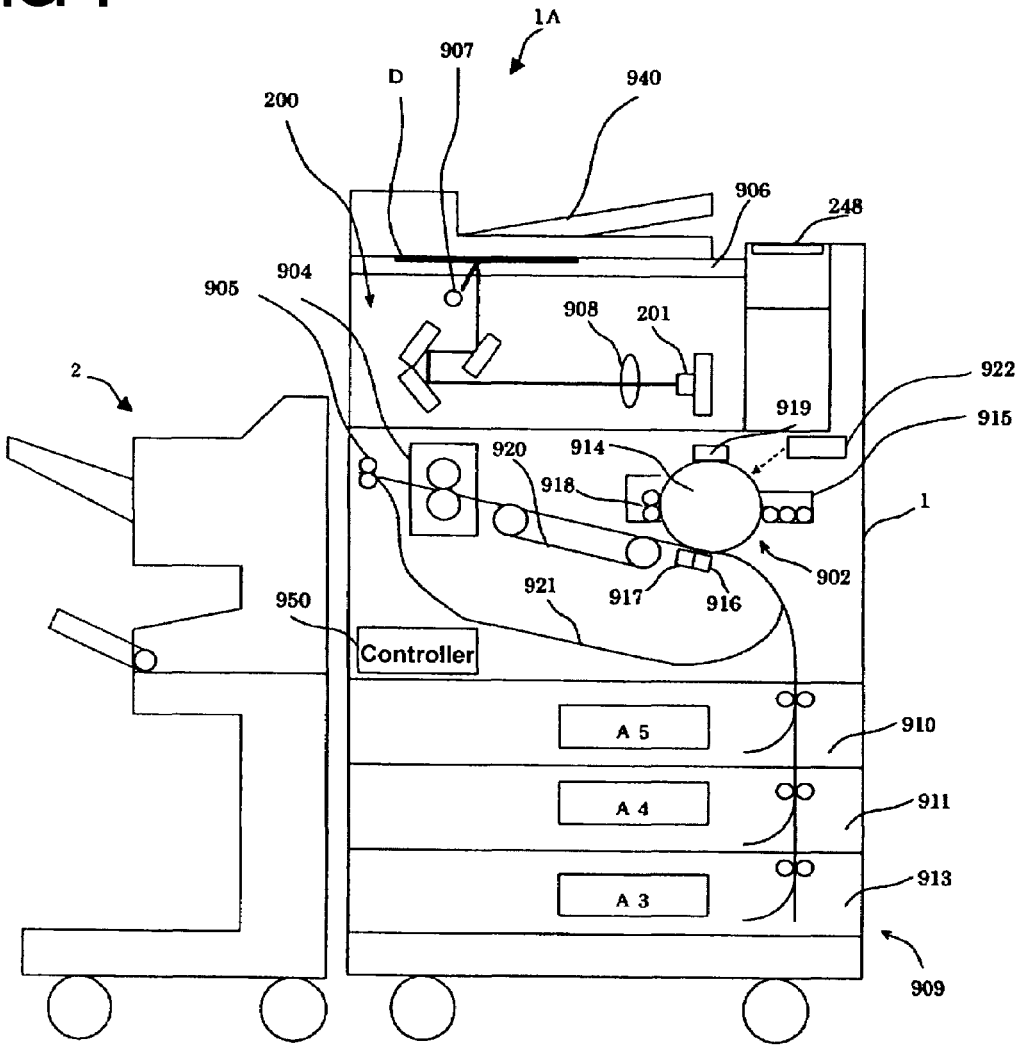
FIG. 1 is a side view of a digital copying machine according to an embodiment of the present invention.

Hereunder, embodiments of the present invention will be explained with reference to the accompanying drawings. As shown in FIG. 1, according to the present embodiment, a digital copying machine 1A comprises a digital copying unit 1 for forming a desired image on a sheet, and a sheet finishing apparatus 2 detachable from the digital copying unit 1 for applying a stapling process to the sheet ejected from the digital copying unit 1.

The digital copying unit 1 comprises an image forming apparatus 902, as an image forming device for recording an image copied from an original image D onto a sheet; an image input unit 200 provided with a light source 907 for irradiating the original image D placed above the image forming apparatus 902 and focusing light reflected from the original image D on a CCD 201 through an optical system 908 to function as a scanner; a sheet feeder 909 disposed under the image forming apparatus 902 as a sheet feeding device for feeding the sheet to the image forming apparatus 902 one at time; and a control unit 950 for controlling various units as a positioning device and an image control device.

The sheet feeder 909 is detachable from the digital copying unit 1 and comprises a cassette 910 for containing A5 size sheets, a cassette 911 for containing A4 size sheets and a cassette 913 for containing A3 size sheets.

The image forming apparatus 902 is provided with a cylindrical photosensitive drum 914 for forming a latent image on a circumferential surface thereof. Arranged around the photosensitive drum 914 are a primary electrifier 919 for charging the photosensitive drum 914 to form the latent image; a laser unit 922 for outputting a modulated laser beam according to image data stored in a hard disk 961 (see FIG. 2) to the photosensitive drum 914; a developer 915 for forming a toner image by developing the static latent image formed on the photosensitive drum 914; a transcribing electrifier 916 for transcribing the toner image on the sheet; a separating electrifier 917 for separating the image from the photosensitive drum 914 by charging the sheet with a polarity opposite to the transcribing electrifier 916; and a cleaner 918 for cleaning the photosensitive drum 914.

A laser unit 922 comprises a semiconductor laser for generating the laser beam; a polygon mirror for converting the laser beam output from the semiconductor laser into a beam corresponding to each line through a collimator lens; an fθ lens for converting the leaser beam corresponding to each line output from the polygon mirror into parallel light beams; a mirror for guiding the parallel beams from the fθ lens to the photosensitive drum 914 and rotating the polygon mirror.

A pair of rollers having an endless transfer belt 920 placed thereon is placed on a downstream side of the photosensitive drum 914 and in the vicinity of the separating electrifier 917. The endless transfer belt 920 is placed on a pair of rollers and is located in the vicinity of a photographic fixer 904 provided with a heat roller or the like for heating and fixing the toner image formed on the sheet. On the downstream side of the photographic fixer 904, there is provided a pair of ejection rollers 905 as a part of an ejection transport device for ejecting the sheets whereon the images are formed from the digital copying unit 1. Between a location under the endless transfer belt 920 and an upstream side of the pair of the ejection rollers 905 and the photosensitive drum 914, there is provided a duplex 921 for printing on front and back surfaces of the sheet.

The digital copying unit 1 comprises a platen glass 906 for placing the original D thereon, and a touch panel 248 for indicating a present state of the digital copying machine 1A as well as for inputting on operation command from an operator to the controller 950. Above the platen glass 906, there is provided an automatic original feeder (ADF) 940 for automatically feeding the original onto the platen glass 906 with one end thereof fixed onto a top of the digital copying unit 1 while the other end thereof being left for permitting to be pivotally raised or lowered.

Figure 2:
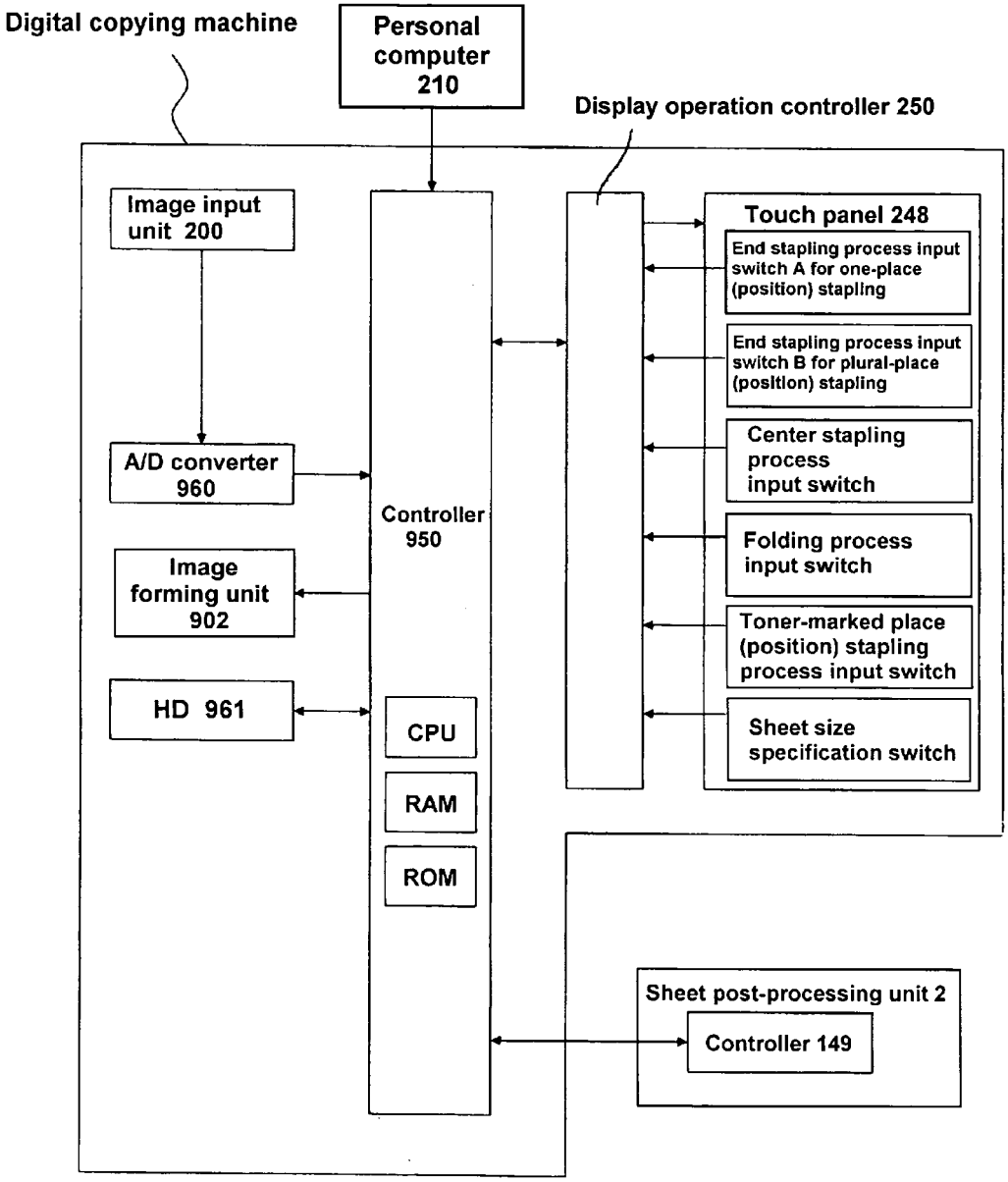
FIG. 2 is a block diagram showing a control unit of the digital copying machine.

As shown in FIG. 2, the controller 950 comprises a CPU as a central data processing unit; a ROM for storing a basic control program of the digital copying machine 1A; a RAM for serving as a work area of the CPU; and an internal bus for connecting these components. The controller 950 is connected with an external bus. The external bus is connected through an interface (not shown) with a personal computer 210; an A/D converter 960 for converting the analog image data output from an image input unit 200 to a digital data; an image forming apparatus 902; a hard disk (HD) 961 for storing the image data output from the image input unit 200 or the personal computer 210; a touch panel display operation control unit 250 for controlling a display and an operation command for a touch panel 248; and a controller 149 of the sheet finishing apparatus 2 (described later). The image input unit 200 is connected with the A/D converter 960, while the touch panel display operation controller 250 is connected with the touch panel 248.

On the touch panel 248, in order to receive the operation command from the operator, there is displayed a plurality of switch buttons, namely, an end-stapling process command input switch button A (one position stapling) for stapling one end of a bundle of the sheets at one position; an end-stapling process command input button switch B (plural position stapling) for stapling one end of the sheet bundle at a plurality of positions; a center-stapling process command input switch button for stapling a middle of the sheet bundle; a folding process command input switch button for applying a folding process to a bundle of the sheets to form a book; a toner-marked place stapling process command input switch button for stapling the bundle of the sheets at a position marked with the toner mark (image); a sheet size specification command input switch button for specifying the sheet sizes (A3, A4, A5 or the like).

Figure 3:
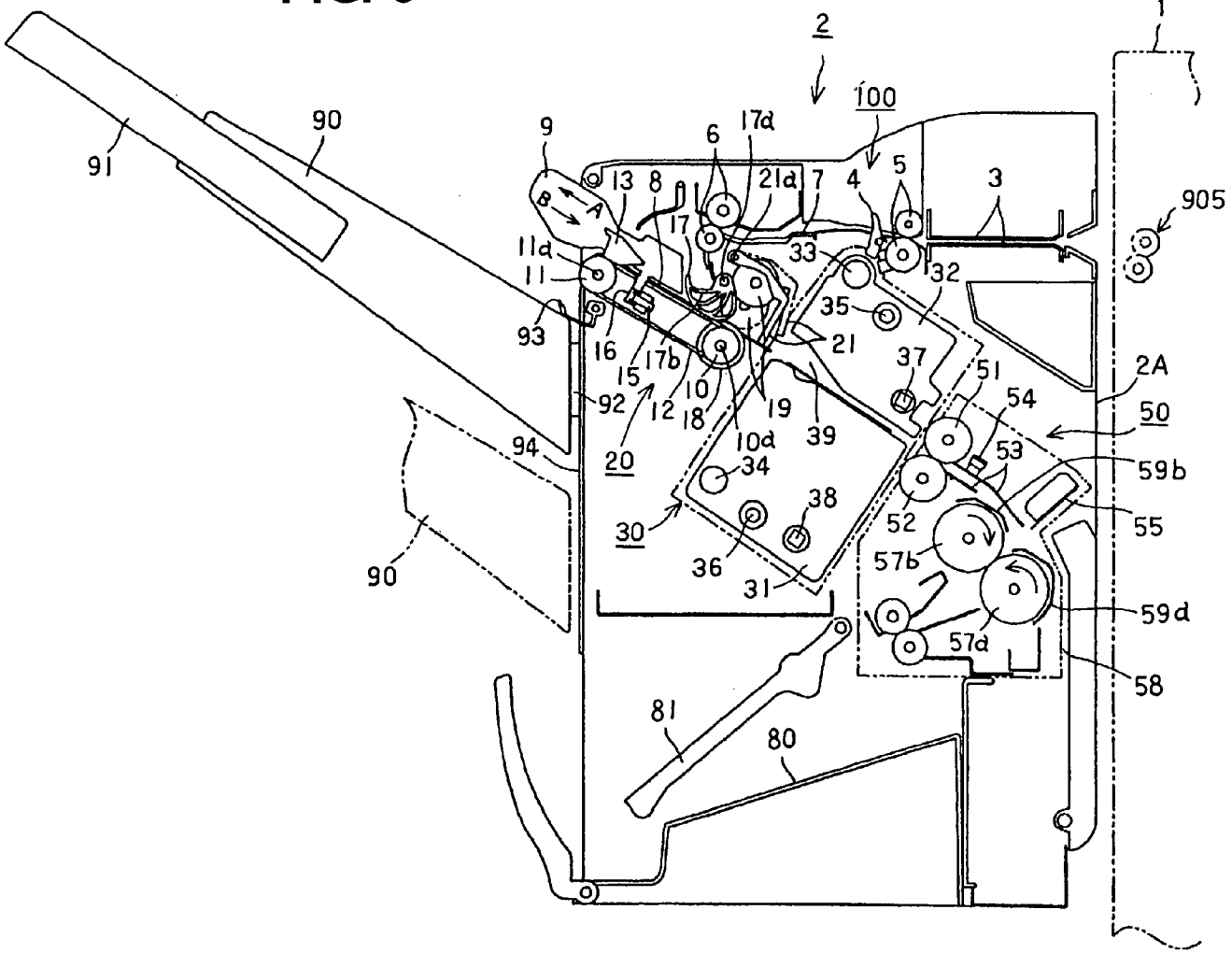
FIG. 3 is a side view of a sheet finishing apparatus.

As shown in FIG. 3, the sheet finishing apparatus 2 comprises, within the casing thereof, a transport device for transferring the sheets ejected from the digital copying unit 1 toward an opposite side of a pair of ejection rollers 905 in a substantially horizontal direction; a transfer unit 100 as a part of the transport device; a sheet bundling unit 20 arranged in an inclined state toward under the sheet bundle forming unit 20 as a sheet bundling device for bundling the sheets; a stapler unit 30 disposed under the sheet bundling unit 20 inclined toward a downstream side of the sheet bundling unit 20 for stapling a bundle of the sheets; a folding unit 50 arranged in an inclined state on a downstream side of the stapler unit 30 for folding the sheet bundle at a predetermined folding line; a stack unit for stacking a booklet or the like; and the controller 149 for controlling units of the sheet finishing apparatus 2 (see FIG. 2).

The transfer unit 100 comprises a transfer guide 3 for receiving the sheets sequentially ejected from the digital copying unit 1 and guiding the sheets into the sheet finishing apparatus 2; an inward transfer guide 7 placed on a downstream side of the transfer guide 3 for further transferring the sheets; a pair of transfer rollers 5 disposed between the transfer guide 3 and the inward transfer guide 7 for nipping and transferring the sheets; a sheet detection sensor 4 placed in the vicinity of a downstream side of the transfer rollers 5 for detecting the sheet transferred into the inward transfer guide 7 as well as jam of the sheets in the transfer unit 100; and a pair of ejection rollers 6 placed on the furthest downstream side of the transfer guide 7 for nipping and ejecting the sheet.

As shown in FIG. 3, the sheet bundling unit 20 comprises a processing tray 8 for loading the sheets ejected from the ejection roller pair 6. The processing tray 8 is arranged in an inclined state downwardly at about 30 degrees relative to a plane of installation of the digital copying unit 1 so as to force the sheet to be transferred toward the downstream side of the sheet. On the processing tray 8, there are provided aligning plates 9 for guiding both ends of the sheets to align the sheets in a width direction.

Figure 4:
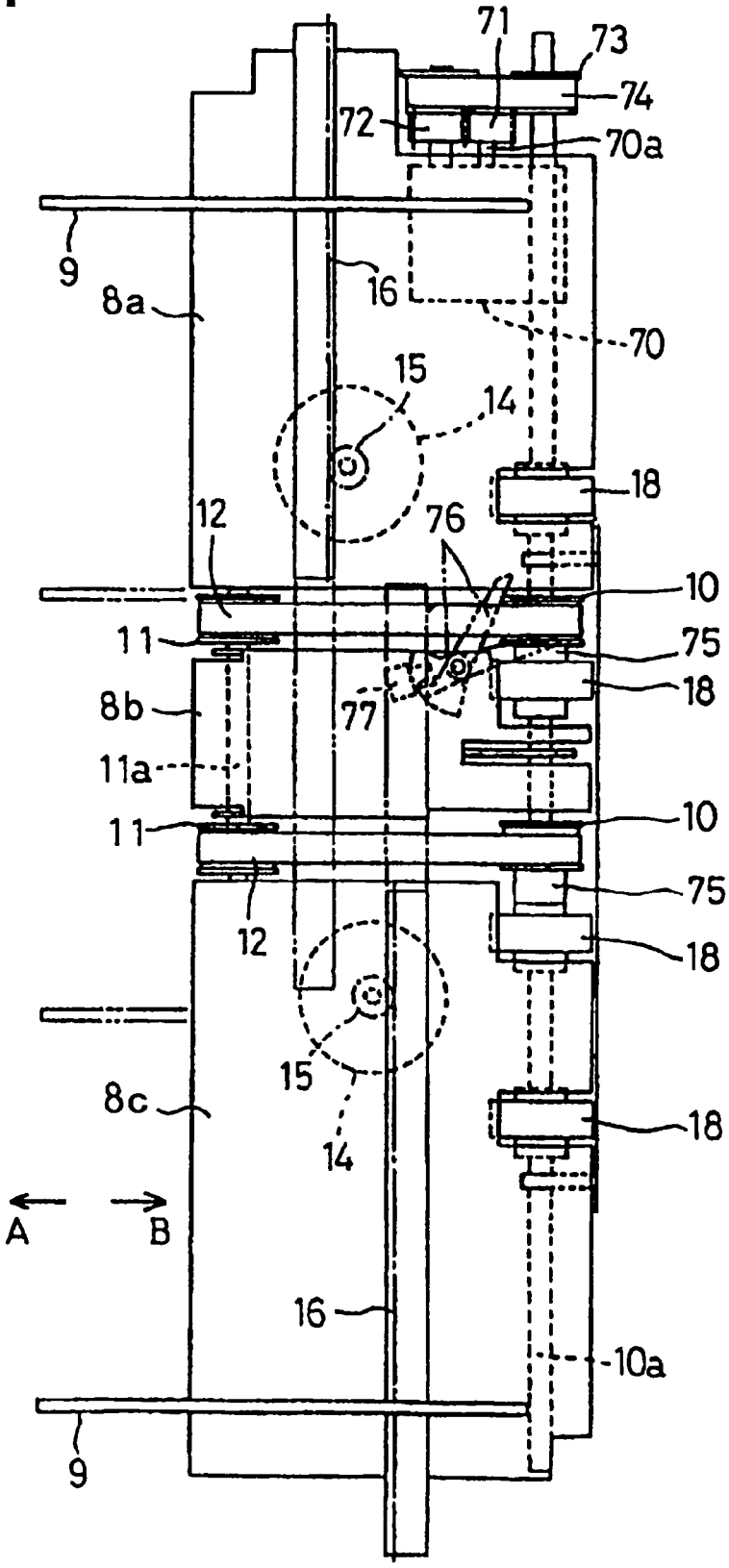
FIG. 4 is a plan view of a processing tray of the sheet finishing apparatus.

As shown in FIG. 4, the processing tray 8 has a rectangular form having a lengthwise side thereof extending across the transfer direction of the sheet (indicated by an arrow direction B), and is divided into three parts, namely a left-hand side tray 8*a* for supporting the left-hand side of the sheet (upside in FIG. 4) to be fed in the transfer direction of the sheet, a central tray 8*b* for supporting the central portion of the sheet, and a right-hand side tray 8*c* for supporting the right-hand side of the sheet (downside in FIG. 4).

Under the lefthand side tray 8*a* and the right-hand side tray 8*c* and near the central tray 8*b*, there are provided matching motors 14, i.e. stepping motors, capable of rotating in both forward and reverse directions. Shafts of the matching motors 14 have pinions 15 fitted thereto respectively, while the pinions 15 respectively engage racks 16 having a length substantially equal to a width of the right-hand side tray 8*a* and the left-hand side tray 8*b*. Each of the matching plates 9 has a rectangular stationary member extending from an underside thereof. Each of the front ends of the stationary members passes through an oblong hole formed along the width of the right-hand side tray 8*a* and the left-hand side tray 8*b* to be fixed to the racks 16 (see FIG. 3) . Accordingly, the matching plates 9 are capable of moving above the left-hand side tray 8*a* and the right-hand side tray 8*c* in the width direction thereof according to the rotation of the matching motors 14.

A stepping motor 70 capable of making forward and reverse rotations is provided under and on one side (on the side of the stapler unit 30) of the left-hand side tray 8*a*. In the stepping motor 70, a motor shaft 70*a* has a gear 71 fitted thereon, while the gear 71 meshes with a gear pulley 72 pivotally supported with a stationary arm extending from the stepping motor 70. A timing belt 74 is placed between the pulley portion of the gear pulley 72 and the pulley 73. The pulley 73 is fixed to a first pulley shaft 10*a* having a length substantially equal to the width of the processing tray 8 and pivotally supported under one side of the processing tray 8. A second pulley shaft 11*a* having a length shorter than the first pulley shaft 10*a* is pivotally supported at a location under the central tray 8*b* and the opposite side to the first pulley shaft 10*a* (the other side of the central tray 8*b*).

The first pulley shaft 10*a* has four underside rollers 18 fitted thereon, i.e., a pair of the rollers on the left-hand side and a pair of the rollers on the right-hand side with respect to the center line of the sheet to be transferred (upside and underside in FIG. 4). The underside rollers 18 for transferring the sheets are provided as hollow rollers such as hollow tires. An external periphery of the underside transfer roller 18 is exposed above a top surface of the processing tray 8 through a notch formed at one side of the processing tray 8 (see FIG. 5).

The shaft 10*a* of the first pulley is fitted with the first pulley 10 having a diameter smaller than the underside roller of the transfer roller 18 through a one-way clutch 75 for transmitting only the counterclockwise turning force. The both ends of the second pulley shaft 11*a* are fitted with the second pulleys 11 having a diameter identical to that of the first pulley. A pair of the first pulley 10 and the second pulley 11 is located between the central tray 8*b* and left-hand side tray 8*a*, while another pair of the first pulley 10 and the second pulley is located between the central tray 8*b* and the right-hand tray 8*c*. Placed on the pairs of the first pulleys 10 and the second pulleys 11 are two sets of endless transfer belts 12. Hence, the rotary driving force of the stepping motor 70 transmitted to the shaft 10*a* of the first pulley 10 through the one-way clutch 75 can be transmitted to the second pulley 11 only when the first pulley turns counterclockwise, that is, only when the transfer belt 12 rotates for transferring in the arrow direction A in FIG. 4. The driving force is not transmitted to the second pulley 11 when the shaft 10*a* of the first pulley 10 turns clockwise (i.e., when the direction of transfer by the transfer belt 12 coincides with the arrow direction B shown in FIG. 4).

As shown in FIG. 3, under the inward transfer guide 7 and above the processing tray 8, there is provided a paddle 17, for pushing the sheet in the transfer direction by moving pivotally round the shaft 17*a*. The paddle 17 is made of an elastic material having a specified elasticity such as rubber or the like, and is provided with integrally formed fins 17*b* extending radially around an axis 17*a*. The paddle 17 is designed to readily change a form thereof when the sheets are ejected or accumulated on the processing tray 8, thereby applying appropriate pressure to the sheet in the transfer direction.

Figure 5:
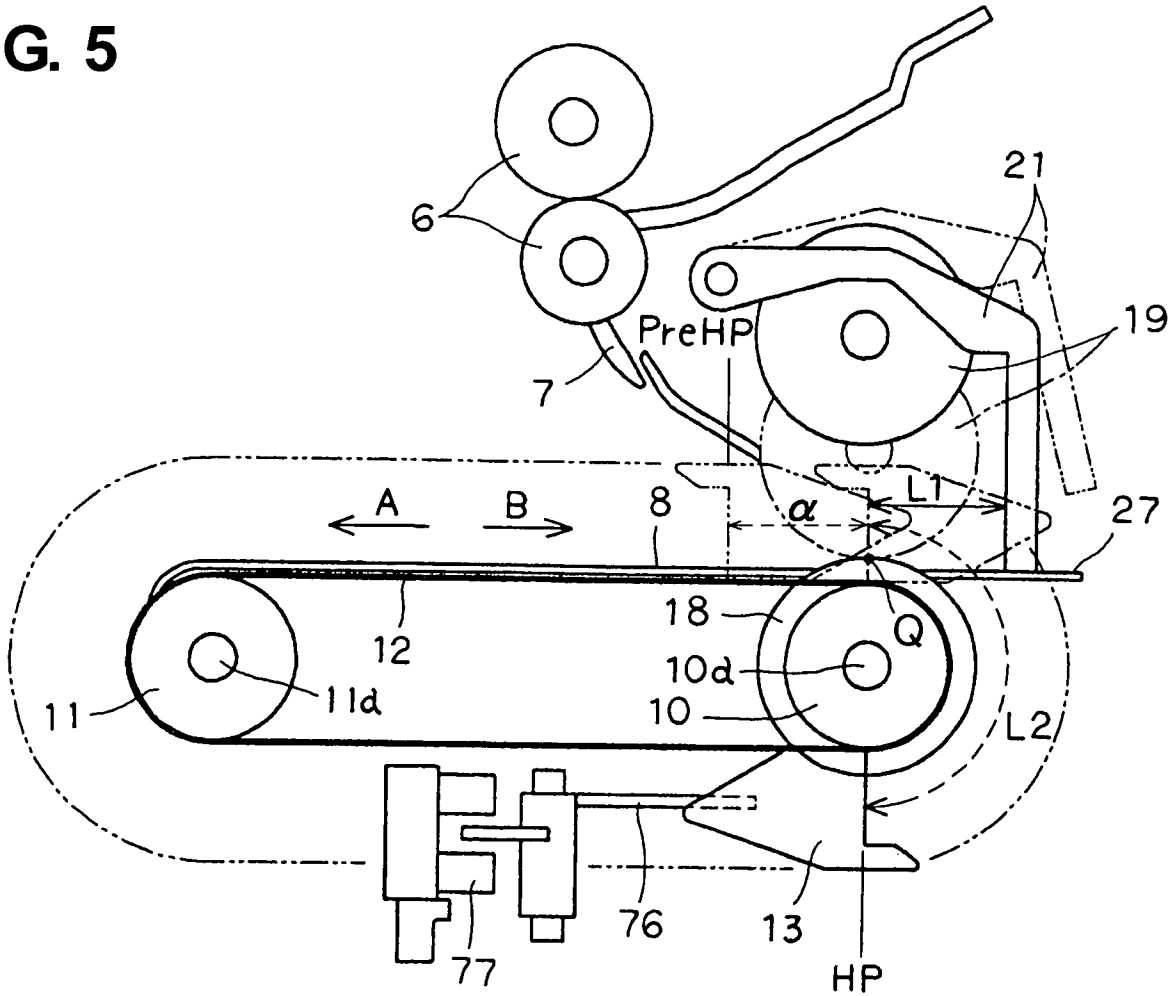
FIG. 5 is a side view showing a transfer belt of the processing tray in the sheet finishing apparatus.

As shown in FIG. 5, the transfer belt 12 is provided with a pushing claw 13 securely fixed thereto for abutting against one end of the bundle of the sheets to be pushed toward the arrow direction A. The pushing claw 13 has a home position (hereinafter referred to as HP) located at a position where an end face of the pushing claw coincides with a point immediately under the shaft 10*a* of the first pulley. Under the transfer belt 12, there are provided a detection arm 76 for engaging the pushing claw 13 to detect the HP, and an arm detection sensor 77 comprising a detection arm 76 and an integrally formed transmission type sensor 77 (see FIG. 4).

Above the underside transfer rollers 18, there is provided the upside transfer rollers 19 movable freely between a contact point (i.e., a first contact point) or a contact point Q where the upside roller and the underside roller 18 abut against each other as indicated with a phantom line in FIG. 5 and a point (a second point) where the upside transfer roller 19 is separated from the underside transfer roller 18 as indicated with a solid line. The upside transfer roller 19 moves between the contact point and the separated point through a cam or the like (not shown), and the turning force of the upside transfer roller 19 is obtained from the stepping motor 70 through a gear (not shown).

On the downstream side of the inclined surface of the processing tray 8, there is provided a plate-form first sheet bundle guide 27 for supporting (holding) the sheet bundle in cooperation with the processing tray 8. Above the first bundle guide 27, there is provided a stopper 21 for controlling and aligning one end of the sheet to move the sheet in the transfer direction by its own weight and the rotation of the paddle 17.

Figure 6:
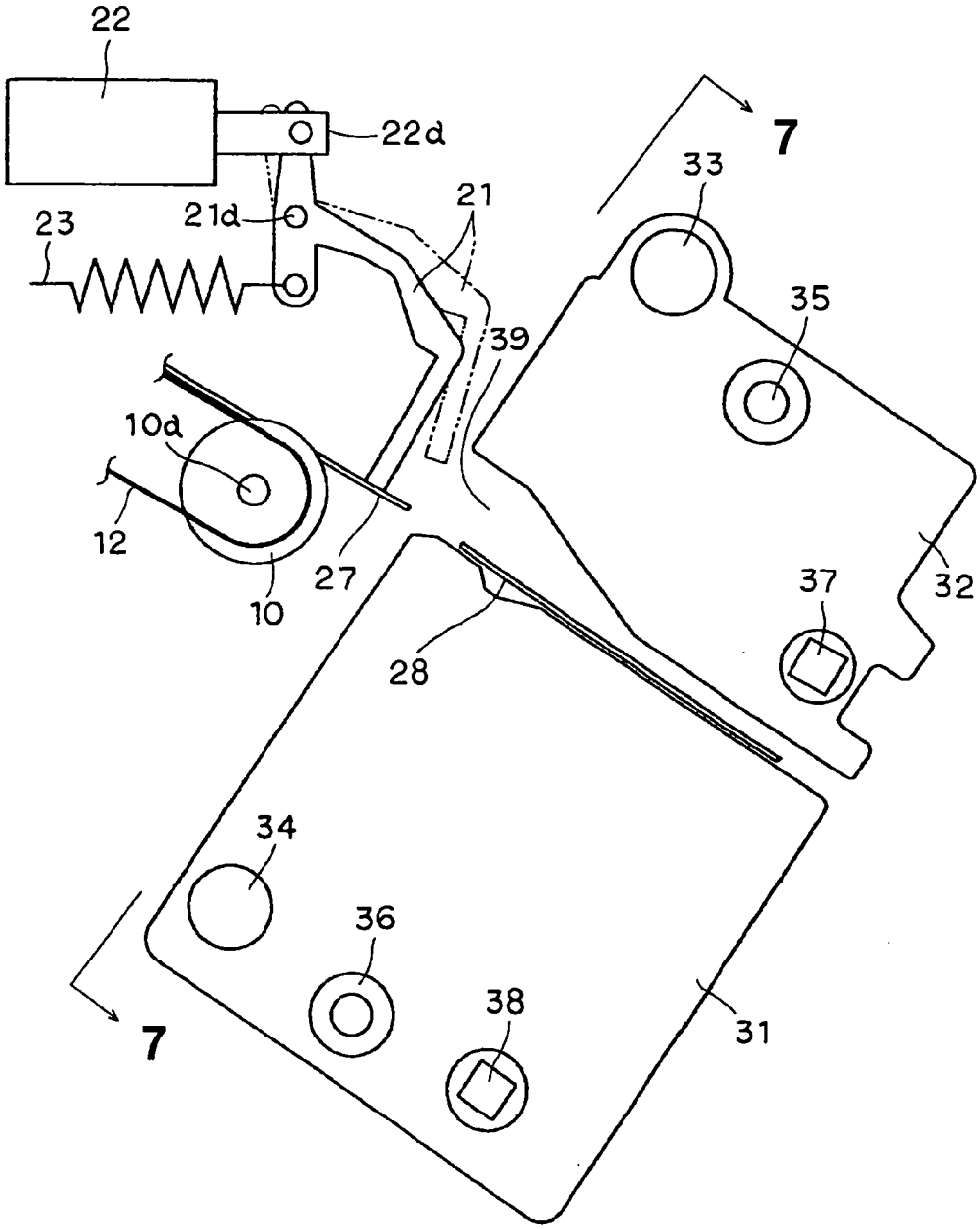
FIG. 6 is a side view showing a stopper of the sheet finishing apparatus.

As shown in FIG. 6, the stopper 21 comprises a leg portion and an arm portion constituting substantially a J-shape (section) as the whole. One end of the arm of the stopper 21 is fixed to a plunger 22*a* of a solenoid 22, while the other end of the arm of the stopper 21 is kept pulled by a predetermined tensile force of a spring 23. Thus, according to the on-off action of the solenoid 22, the stopper 21 is movable freely around a supporting shaft 21*a* located substantially at the center of the arm to serve as a supporting point, and between the regulated position, where a bottom (far end) of the leg portion abuts against a top surface of the first bundle guide 27 as indicated with a solid line, and the retracted position, indicated with the phantom line, that is, the position retracted from the top surface of the first bundle guide 27. While at rest (while the solenoid 22 is turned off), the stopper 21 is at the retracted position indicated with the phantom line.

The pushing claw 13 in an ordinary state (the state where the transfer roller 19 is at the separated position while the stopper 21 is at the retracted position) moves in the arrow direction A shown in FIG. 5. A relationship between a distance L1 and a distance L2 is set so as to be L1<L2, where L1 is a distance from the end surface of the pushing claw 13 to the stopper 21 when the end surface of the pushing claw 13 is at the contact point Q between the underside roller 18 and the upside transfer roller 19, an L2 is a distance from the end surface of the pushing claw 13 at HP to the end surface of the pushing claw 13 at the point Q. As shown in FIG. 5, the end portion of the inward transfer guide 7 extending downwardly from the ejection roller pair 6 engages a stationary guide for preventing the end of the sheet ejected onto the processing tray 8 from jumping upwardly over the upside transfer roller 19.

As shown in FIGS. 3 and 6, the stapler unit 30 is located on the downstream side of the sheet bundling unit 20, and comprises a head assembly 31 for driving the staples provided with a staple cartridge and located under a transfer passage 39; and an anvil assembly 32 located above the transfer passage 39 for receiving and bending the front ends of the staple driven by the head assembly 31. On the top of the head assembly 31, as a transfer passage 39, there is provided a plate-like second bundle guide 28 having an inclination coinciding with the inclination of the first bundling guide 27 on the side of the sheet bundling unit 20, so as to avoid the location of the staple driving head for driving the staples from the head assembly 31. The stapler unit 30 is provided as indicated with the phantom line in FIG. 3, and is designed so as to be removed from the sheet finishing apparatus 2 toward the operator for refilling the staples as shown in FIGS. 3 and 6.

Figure 7:
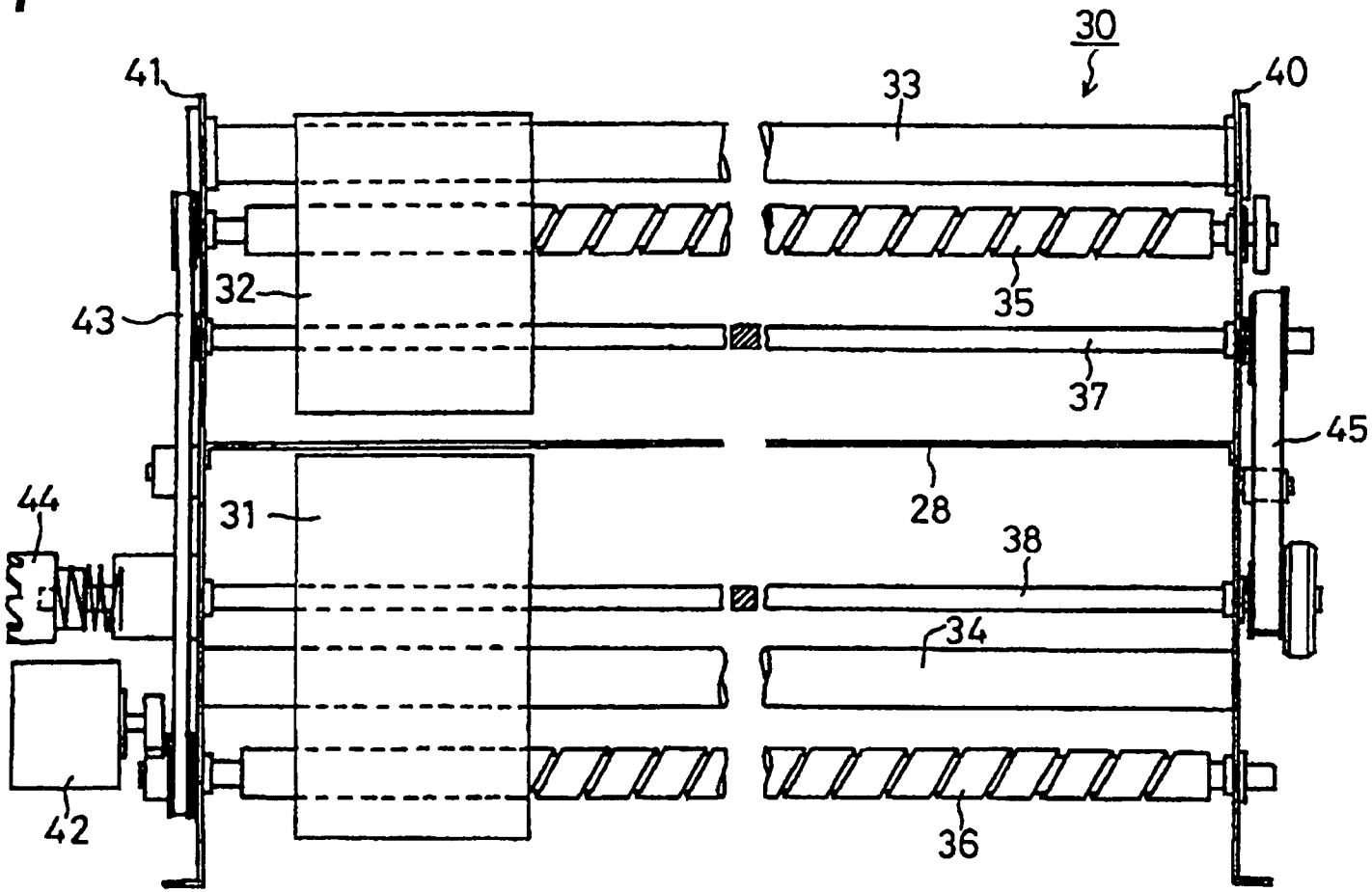
FIG. 7 is a front view of a stapler unit in the sheet finishing apparatus viewed from line 7—7 in FIG. 6.

As shown in FIG. 7, the stapler unit 30 provided between the left-hand side frame 40 and the right-hand side frame 41 comprises a head assembly 31; an anvil assembly 32; columnar guide rods 33 and 34 provided respectively for supporting and guiding the head assembly 31 and the anvil assembly 33 in a direction intersecting the transfer direction of the sheet; guide screw shafts 35 and 36 respectively provided with the helical threads for slidably transferring the head assembly 31 and the anvil assembly 32 in the direction intersecting the transfer direction of the sheet; and an anvil drive shaft 37 and a head drive shaft 38 having a square section for letting the head assembly 31 and the anvil assembly 32 to carry out the staple driving operation and the staple bending operation, respectively.

The head assembly 31 and the anvil assembly 32 mesh with the guide screw shafts 36 and 35 through threads so as to be movable leftward and rightward as shown in FIG. 7 according to the rotation of the guide screw 36 and the guide screw 35. Outside the unit frame 41, there is provided a stapler sliding motor 42 for rotating the guide screw shaft 36 either in normal or reverse direction through a gear. On the outside of the unit frame 41, there is provided the stapler sliding motor 42 for rotating the guide screw shaft 36 either in normal direction or reverse direction through a gear. The drive of the staple sliding motor 42 is simultaneously transmitted to the anvil assembly 32 by means of a timing belt 43 placed between the pulleys fitted with the guide screw shafts 36 and 35 respectively on the outside of the unit frame 41.

The drive force to the head drive shaft 38 is also transmitted from a stapling/folding operation motor (not shown), as being a stepping motor, through a coupler 44 provided on the outside of the unit frame 41. The drive force from the stapling/folding operation motor is transmitted simultaneously to the anvil assembly 32 through the timing belt 45 placed between the pulleys respectively fitted with the head drive shaft 38 and the anvil drive shaft 37 on the outside of the unit frame 40. Hence, the head assembly 31 and the anvil assembly 32 synchronously move in the direction intersecting the transfer direction of the sheet while maintaining the relative distance thereof. Accordingly, a moving mechanism is provided for the head assembly 31 and the anvil assembly 32 by controlling the stapler sliding motor 42, so that the stapling operation can be carried out at any position on a width of the sheet. The moving mechanism functions as a moving mechanism for enabling the head assembly 31 and the anvil assembly 32 to travel to a location of the sheet bundle.

As shown in FIG. 3, the folding unit 50 is provided as a unit (indicated by a phantom line) located on the downstream side of the stapler unit 30, and is designed so as to be taken outside from the sheet finishing apparatus 2 similarly to the stapler unit 30.

At an entrance to the folding unit 50, there are provided the upside sheet bundle transfer roller 51 and the underside sheet bundle transfer roller 52 for nipping and transferring the sheet bundle toward the downstream side. On the downstream side of the upside sheet bundle transfer roller 51 and the underside sheet bundle transfer roller 52, there is provided a sheet bundle transfer guide 53 for guiding the sheet bundle to a further downstream side. On the sheet bundle transfer route of the sheet bundle transfer guide 53, there is provided an integral transmission type end detection sensor unit 54, wherein a controller 149 moves the upside bundle transfer roller 51 and the underside bundle transfer roller 52 to be pressed against each other responding to a sheet bundle end detection signal from the end detection sensor 54, and also controls the setting of the folding position in the sheet transfer direction.

The upside roller 51 for transferring the sheet bundle is designed so as to move between a position for contacting the underside roller 52 for transferring the sheet bundle and a position (not shown) away from the position, and is also designed so as to be away from the underside roller 52 until the front end of the sheet bundle is detected by the end detection sensor 54 for contacting the sheet bundle.

Under the transfer guide 53, there is provided a pair of rollers, namely a folding roller 57*a* and a folding roller 57*b*, rotating and pressed with each other in a direction intersecting the transfer direction of the sheet bundle. The folding rollers 57*a* and 57*b* have a diameter (e.g., 40 mm) for turning at least once or more when folding the sheet bundle.

On the downstream side of the transfer guide 53 corresponding to the direction intersecting the transfer direction of the sheet bundle, there is provided a pushing plate 55 with a front edge advancing near a point where the folding rollers 57*a* and 57*b* are pressed against each other until the sheet bundle enters between the folding rollers 57*a* and 57*b*. The pushing plate is made of stainless steel, and the front edge is formed to have a thickness of about 0.25 mm.

Partially surrounding above the folding rollers 57*a* and 57*b*, there are provided backup guides 59*a* and 59*b* having a substantially semicircular section. The backup guides 59*a* and 59*b* move together with the up and down movement (of the folding rollers 57*a* and 57*b*) in the direction intersecting the transfer direction of the sheet bundle by the pushing plate 55 to provide a space around the folding rollers 57*a* and 75*b* when the front edge of the pushing plate moves close to the nipping point between the folding rollers 57*a* and 57*b*.

On the downstream side of the sheet folder unit 50 and under the sheet finishing apparatus 2, there are provided a sheet bundle forming unit 20; a stapler unit 30; and a stacker 80 for placing the folded sheet bundles having an inclined surface opposite to the stapler unit 30 and the sheet folding unit 50. Above the stacker 80, there is provided a folded sheet holder 81 with one end thereof pivotally fixed for holding the folded sheet through a falling force resulting from the inclined surface of the stacker 80 and a force of a spring or the like.

On the side of the frame 2A opposite to the body of the digital copying machine 1, there is provided a tray with lift 90 capable of rising and falling vertically along the frame 2A. The tray with lift 90 is supported with a supporter 92. The supporter 92 of the tray with lift 90 ascends and descends through a belt driven by a stepping motor (not shown) capable of rotating clockwise and counterclockwise. The tray with lift 90 is capable of ascending and descending between an ascending limit indicated with a solid line and a descending limit indicated with a phantom line.

The tray with lift 90 comprises an auxiliary tray 91 to be drawn out from the tray with lift 90 when loading the tray with the large-size sheets or the like. Under the second pulley 11 of the sheet bundling unit 20, there is provided a sheet surface sensor 93 for detecting the top surface of the sheet on the tray with lift 90. On the side of the tray with lift 90 of the frame 2A, there is provided a rear end guide 94 for guiding the rear end of the sheet on the tray with lift 90 when the tray with the lift 90 ascends and descends. The sheet bundle folded by the sheet folding unit 50 is stacked on the folded sheet bundle stacker 80, and when not folded, the sheet bundle is stacked on the tray with lift 90.

The controller 149 functions as a work area for the CPU and the ROM for storing the program and the program data to be executed by the CPU, and comprises the RAM for storing the control data received from the controller 950 of the digital copying machine 1 and an interface, thereby communicating with the controller 950.

An operation of the digital copying machine 1A according to the present invention will be described with reference to a flow chart.

The CPU of the controller 950 shows an initial display on the touch panel 248 through the touch panel display controller 250. At this point, as shown in FIG. 2, the touch panel 248 (or the display screen of the personal computer 210) displays a button of the input switch A for the end stapling process (one-place stapling); a button of the input switch B for the end stapling process (plural-place stapling); a button of the input switch for the center stapling; a button of an input switch for the folding process; a button of an input switch for the toner-mark-basis stapling process; a button of a sheet size specification switch; a button of a printing mode selection switch for selecting a two-side printing mode for printing the image on both sides of the sheet or a one-side printing mode for printing the image on one side of the sheet; a clear button for clearing the printing mode or any other selections made once; a start button for starting the digital copying machine 1 to print the image according to the selected mode or the like; an indication of a standby state or ready state (for the printing operation) of the digital copying machine 1A, the number of the sheets with the image; and so on. The operator presses a proper button, for instance, for specifying the number of the copies needed, before pressing the start button for sending a necessary operational command to the digital copying machine 1A. All or a part of such operational commands can also be given through the personal computer 210.

Figure 9A:
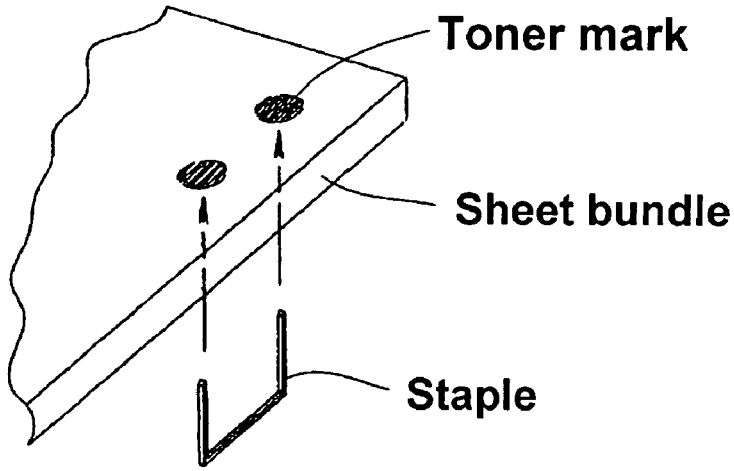
FIGS. 9(*a*) and 9(*b*) are perspective views showing staples driven into a bundle, wherein FIG. 9(*a*) shows a case of stapling with a toner mark, and FIG. 9(*b*) show a case of stapling without the toner mark.
Figure 9B:
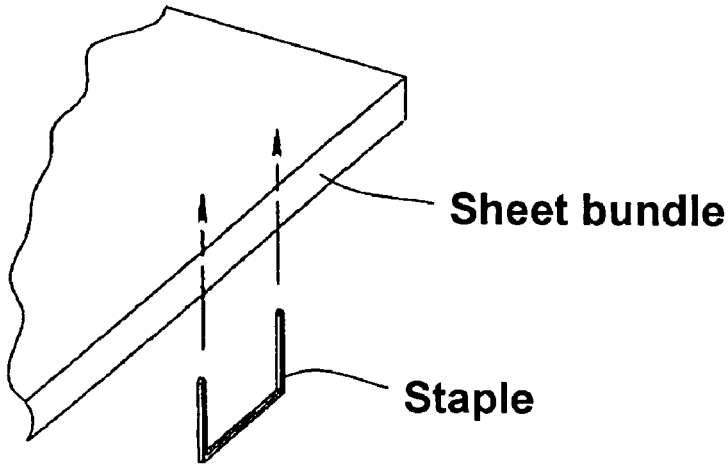

The operations of the various buttons shown in FIG. 2 will be described briefly. First, the toner-mark-basis stapling process is the sheet bundle stapling process in which the toner mark corresponding to the stapling position is provided on the backside of the sheet (referred to as a toner-marked place). In the sheet finishing apparatus 2, a plurality of aligned sheets is bundled by the sheet bundling unit 20. The bundled sheets are stapled from the side of the sheet opposite to the side whereon the toner mark is provided (i.e., the side opposite to the side whereon the toner mark is provided) by the stapling unit 30. FIG. 9(*b*) shows a stapling process without the toner-mark-basis stapling process, wherein the toner mark for indicating the stapling position is not provided on the back of the sheets to be stapled.

Figure 11A:
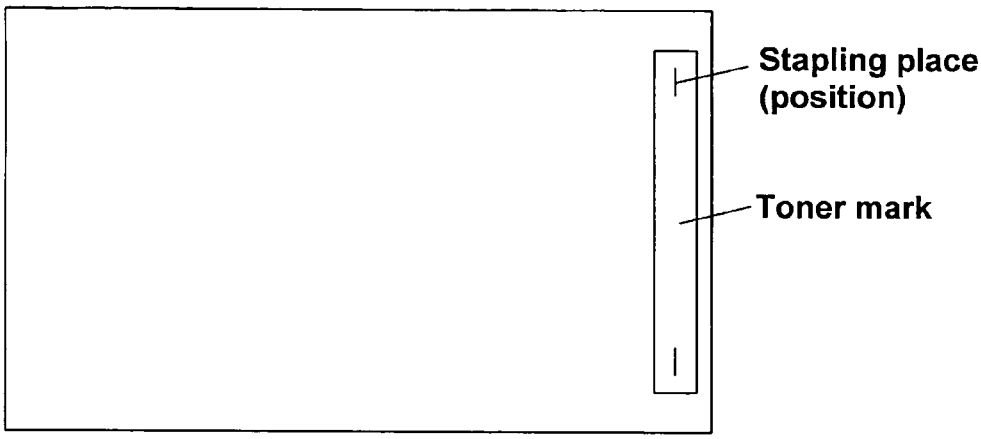
FIGS. 11(*a*) to 11(*c*) are plan views showing toner marks (images) and stapling positions, wherein FIG. 11(*a*) shows a case that an end portion is stapled at a plurality of stapling positions and the toner mark is formed in a strip shape covering the stapling positions, FIG. 11(*b*) shows a case that an end portion is stapled at a plurality of stapling positions and the toner marks are separately formed at positions covering the stapling positions, and FIG. 11(*c*) shows a case that a center portion is stapled and the toner marks are separately formed at pairs of stapling positions corresponding to ends of staples.
Figure 11B:
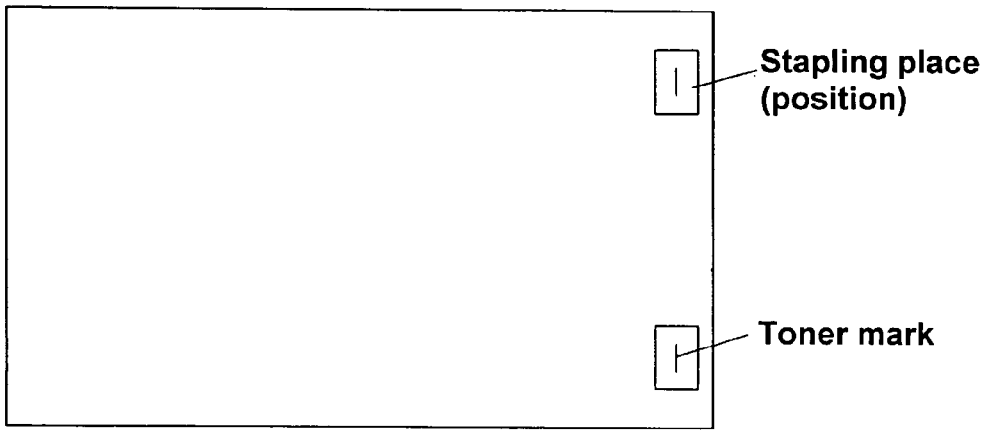
Figure 11C:
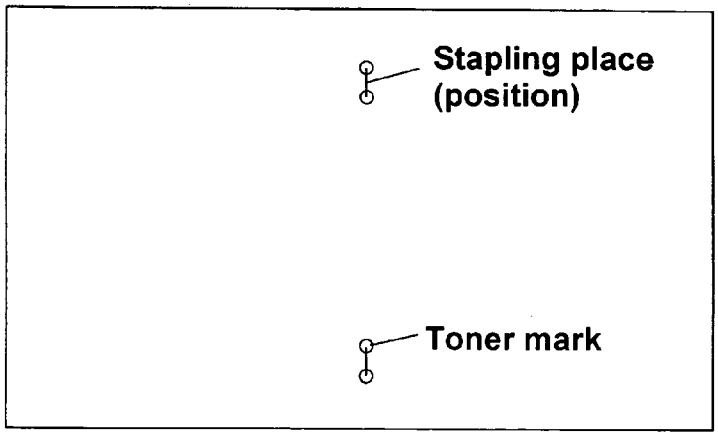

The toner mark to be provided on the stapling position may be a single-block type continually covering a plurality of stapling positions as shown in FIG. 11(*a*); a separated type covering the separate stapling positions as shown in FIG. 11(*b*); or a type of circular toner marks provided corresponding to positions of the legs of the staple as shown in FIG. 11(*c*). In the case of the toner mark shown in FIG. 11(*c*), circular toner marks are provided corresponding to the positions of the individual legs (two penetrating needles) of the staple. In the digital copying machine unit 1 according to the present embodiment, in order to save the toner, the toner mark type shown in FIG. 11(*c*) is employed. In the toner mark type, the separate type toner marks are provided at positions corresponding to the individual penetrating legs of the stapler provided on the side of the sheet opposite the side whereon the desired image is to be copied.

The stapling process to be carried out by the sheet finishing apparatus 2 according to the present embodiment is available in two modes, namely, the end stapling process mode and the center stapling process mode. The end stapling process is further divided into the end stapling process (for one-place stapling) shown in FIG. 9(*a*), and the end stapling process (for plural-place stapling) shown in FIGS. 11(*a*) and 11(*b*). In the center stapling process shown in FIG. 11(*c*), the sheets are stapled at a plurality of stapling positions locating along the center line of the sheet. In the folding process, the sheets are bundled into a book by folding the sheets along the stapling positions, as shown in FIG. 11(*c*), by using the folding unit 50.

When the operator presses (or touches) a proper button displayed on the touch panel 248 and then presses the start button, the CPU of the controller 950 executes the image forming routine for forming the desired image onto the sheet.

Figure 8:
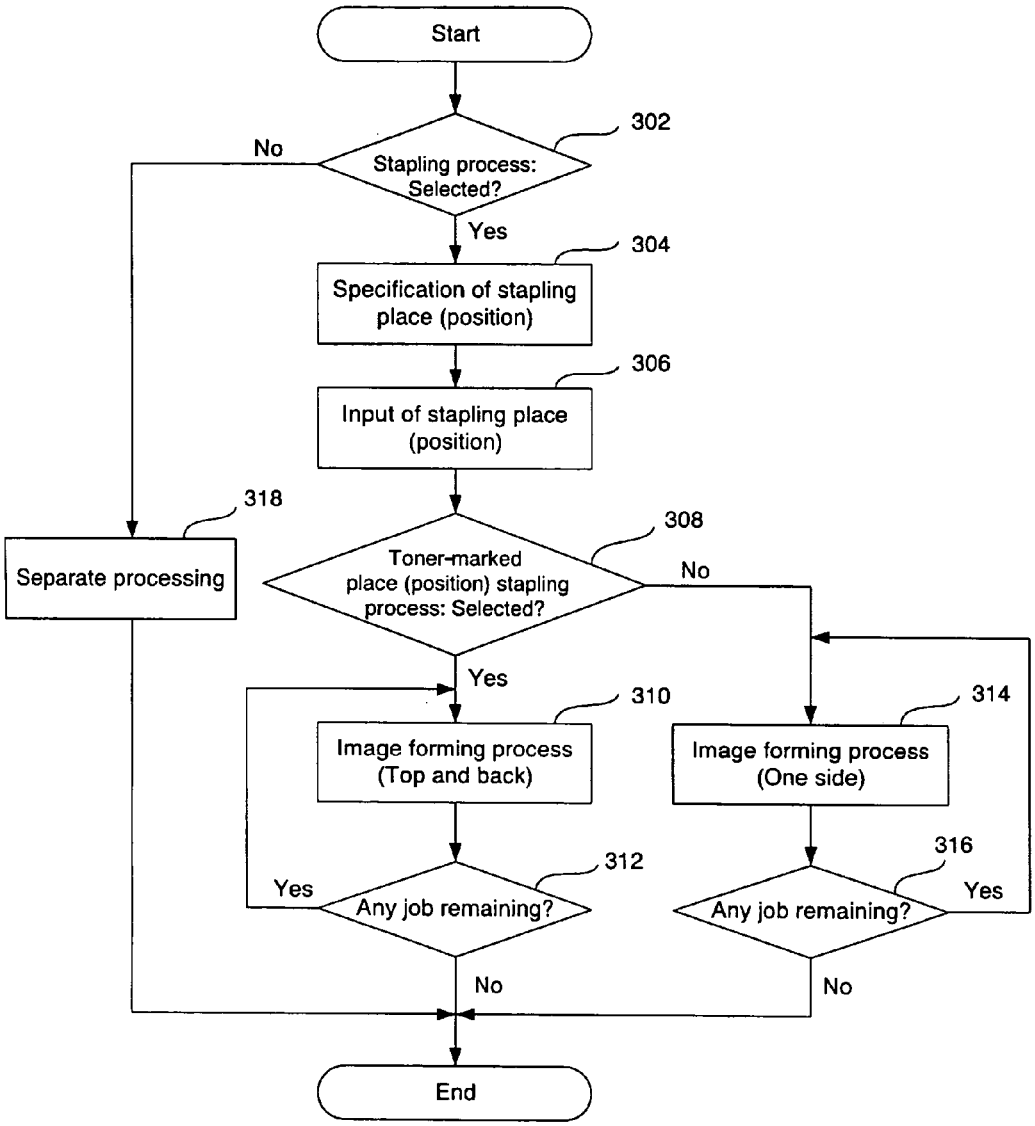
FIG. 8 is a flow chart showing an image forming routine carried out by a CPU of the control unit in the digital copying machine.

As shown in FIG. 8, in the image forming (transcription) routine, first, in step 302, it is determined whether one of the end stapling process input switch A (for one-place stapling), the end stapling process input switch B (for plural-place stapling), and the switch for the center stapling process is pressed to select the one of the stapling processes. When an negative response is given indicating that the process other than the stapling mode has been selected in step 318, the ordinary image forming process (copying process) will take place to complete the image forming routine. When an affirmative response is given indicating that one of the stapling processes has been selected by using one of the end stapling process input switch A button (for one-place stapling), the end stapling process input switch B button (for plural-place stapling), and the center stapling process switch button, the sheet size has been specified by the sheet size specification switch in step 304, and the stapling positions will be decided according to the specified sheet size.

More specifically, the stapling positions according to the sheet size and the types of stapling processes such as the end stapling (one-place stapling), the end stapling process (plural-place stapling), and the center stapling process are previously stored, for example, in the form of a table in the memory, so that the CPU decides (or selects) the stapling positions referring to such table. In the following description, it is supposed that the end stapling process input switch A button (for one-place stapling) and the sheet size specification switch button (for A4 size) have been pressed by the operator.

In the next step 306, information relating to the control of the sheet finishing apparatus 2 such as the stapling position, the sheet size, or the like will be inputted to the controller 149 of the sheet finishing apparatus 2 through a communication device. In such a communication mode, it is not necessary to directly input the information such as the stapling position (e.g., actual distance from an end of the sheet), and, instead, the default value common to the controller 950 and the controller 149 may be used. In order for the default value common to the controller 950 and the controller 149 to be recognized, for example, the default value according to the common table may be stored in the ROM, or a content of the default value may be inputted to the controller 950 from the controller 149 at the time of the initial setting after the sheet finishing apparatus 2 is turned on.

Next, in step 308, it is detected whether the input switch for the toner-mark-basis stapling process has been pressed. When the response in the step 308 is affirmative, the image formation process (on both sides of the sheet) is carried out. In other words, when the sheet feed signal is outputted from the controller 950, the sheet with the specified sheet size (A4 size sheet in the present example) is fed to the image forming apparatus 902 from one of the sheet cassettes 910, 911, and 913 with an electric motor (not shown). Improper orientation of the sheet is corrected by a registration roller pair simultaneously with synchronization of the timing before the sheet is transferred to the image forming apparatus 902.

The CPU commands the image input unit 200 to read the data D and to project the image data for one sheet line by line onto the photosensitive drum 914 with the laser unit 922. The photosensitive drum 914 is previously charged with the electricity by means of the primary electrifier 919, so that the electrostatic latent image is formed on the photosensitive drum 914 when irradiated with light. The electrostatic latent image is developed by means of the developer 915 to form the toner image on the photosensitive drum 914.

In the image forming apparatus 902, the toner image on the photosensitive drum 914 is transcribed onto the sheet by means of the transcription electrifier 916. The toner image on the sheet is charged inversely to the transcription electrifier 916 by means of the separation electrifier 917 to be separated from the photosensitive drum 914. Further, the sheet, undergone the separating electrification process, is transferred to the photographic fixer 904 where the image is permanently fixed onto the sheet by the photographic fixer 904 to obtain the desired image on the sheet.

In the toner-mark-basis stapling process as described previously, the toner mark is provided on the backside of the sheet opposite to the top surface of the sheet whereon the desired image is formed. In the present embodiment, the toner marks shown in FIG. 9(*a*) are provided on the backside of the sheet by using the duplex 921. Then, the sheet having (the toner image and the toner mark) provided on the top surface and the backside thereof is ejected (transferred) toward the sheet finishing apparatus 2 from the digital copying machine 1 by means of the ejection roller 905. In step 312, it is determined that there are any unprocessed jobs. When the result is affirmative, the program returns to step 310 to process the remaining jobs. When the result is negative, the image forming routine is finished.

When the response in step 308 is negative, the image is formed on one side of the sheet in step 314 (toner mark is not formed on the backside of the sheet; refer to FIG. 9(*b*)). In step 316, it is determined whether there are any unprocessed jobs. When the response is affirmative, the program returns to step 314 for processing the remainders of the jobs. When the response is negative, the image forming routine is finished.

The following typical modes applicable to the post-processing of the sheets ejected from the digital copying machine 1 are carried out by the sheet finishing apparatus 2: (1) the non-stapling mode wherein the sheets are stacked on the tray with the lift 90 without undergoing the stapling process; (2) the end stapling mode wherein the stapling is provided at one or more places on one end of the sheets in the transfer direction before being stacked on the tray with lift 90; and (3) the center stapling and folding mode wherein the sheets are stapled at one or more places on the folding line at a middle of the length of the sheet along the transfer direction and subsequently folded along the line including the stapled places to form a book before being stacked on the folded sheets ejection stacker 80 or the like. The operations of the sheet finishing apparatus 2 in these modes will be described.

(1) Non-Stapling Mode

When the non-stapling mode is selected, the controller 149 first drives the stepping motor 70 to move the pushing claw 13 from HP, shown in FIG. 5, to the pre-home position (hereinafter referred to as PreHP) as a reference for stacking the sheets on the processing tray 8. At this point, the upside transfer roller 19 is at the separated position, and the stopper 21 is at the retracted position. The preHP is a location away from the HP of the pushing claw 13 by a distance (L2+α), that is, the location close to the tray with the lift 90 from the contact point Q between the underside transfer roller 18 and the upside transfer roller 18 by a distance α. Further, the movement by the distance (L2+α) can be measured by counting the number of steps of the stepping motor 70.

In parallel, a transfer motor (not shown) is driven to rotate the drive roller of the transfer roller pair 5 and the drive roller of the ejection roller pair 6 until the sheets are ejected from the ejection roller pair 905 of the digital copying machine 1. When the sheets are ejected from the digital copying machine 1, the sheet is transferred to the processing tray 8 by the transfer roller pair 5 and the ejection roller pair 6. When the sheet detection sensor 4 detects the sheet, the controller 149 sets the timing for starting the matching motor 14 for moving the matching plate 9 and the timing for starting the paddle motor for rotating the paddle. Further, the controller 149 previously receives the control data concerning the sheet size, the transfer directions (horizontal and vertical directions) of the sheet from the controller 950 of the digital copying machine 1, and stores such control data in the RAM.

When the sheet is ejected onto the processing tray 8, the matching motor 14 and the paddle motor are driven. Accordingly, the matching plate 9 moves in the direction intersecting the transfer direction of the sheet to match the ends of the sheets and rotate the paddle 17 to align the ends of the sheets at the front end of the pushing claw 13 located at the preHP. The operation is repeated each time when the sheet is ejected onto the processing tray 8.

When a predetermined number of the sheets are aligned against the end face of the pushing claw 13, the transfer motor and the stepping motor (not shown) stop. The stepping motor 70 for operating the transfer belt 12 is driven, so that one end of the pushing claw 13 pushes the sheet bundle toward the tray with lift 90 (in the arrow direction A in FIGS. 3 and 5). Accordingly, the sheet bundle is loaded on the tray with lift 90. As a result, the distance L1 becomes smaller than the distance L2 shown in FIG. 5, so that one end of the sheet bundle is pushed toward the tray with lift 90 by the end of pushing claw 13 while being kept vertical, thereby keeping the sheet bundle from unnecessary stress while being transferred.

When the sheet bundle is loaded on the vertically movable tray 90, a motor (not shown) for the tray 90 is driven to lower the tray 90 to a certain extent, and then the motor for the tray 90 is driven inversely to lift the tray 90 until reaching the level where a sheet surface sensor detects the top surface of the sheet. The tray 90 stays at this position until the next sheet bundle is loaded thereon.

In the non-stapling mode without the stapling process, the sheets need not to be transferred to the regulating position of the stopper 21, so that the sheet bundle is pushed toward the vertically movable tray 90 to be stacked thereon by the pushing claw 13 located at the PreHP. Accordingly, even when the sheet ejection speed of the digital copying machine 1 is relatively high, the operational speed of the sheet finishing apparatus 2 can be adjusted to the ejection speed (of the digital copying machine 1). When the PreHP of the pushing claw 13 overlaps with the transfer guide 7 over the top of the pushing claw 13, the sheets transported one at time can be stacked more surely through abutting against the end face of the pushing claw 13.

(2) End-Stapling Mode

In the present embodiment, when the end-stapling mode (one-place stapling) is selected, the controller 149 first drives the stapler sliding motor 42 to move the head assembly 31 and the anvil assembly 32 to their initial positions to be detected by the staple slide HP sensor. Also, the solenoid is turned on and the stopper 21 is located at the controlling position.

A transfer motor (not shown) is driven to rotate the drive rollers of the transfer roller pair 5 and ejection roller pair 6, to eject the sheets from the copying machine 1 onto the processing tray 8, and the matching motor 14 and the paddle motor are driven. The sheets are aligned by the edges along the transfer direction by means of the aligning plate 9, and the sheets stop when the ends thereof reach the side of the leg of the stopper 21. When this operation is repeated for the specified number of the sheets, the sheet bundle is aligned with the stopper 21.

In a state that the sheet bundle is aligned with the stopper 21, the upside transfer roller 19 moves toward the downside transfer roller 18 until the sheet bundle is nipped thereby, and the solenoid is turned off to locate the stopper 21 at the retracted position. The stepping motor 70 is driven for the predetermined number of steps in the direction inversely to the direction in the non-stapling mode. Accordingly, the sheet bundle is held between the upside transfer roller 19 and the underside transfer roller 18, and transferred toward the stapler unit 30 located in the arrow direction B shown in FIG. 3 until the stapling position of the sheet bundle reaches a position of the head of the head assembly 31 coinciding with an initial position of the head. When the stepping motor 70 rotates inversely, since the one-way clutch 75 (refer to FIG. 4) is interposed between the first pulley 10 and the first pulley shaft 10*a*, the drive force of the stepping motor 70 is not transmitted to the transfer belt 12, and the transfer belt 12 and the pushing claw 13 do not move.

A stapling/folding motor (not shown) is driven to apply the stapling to the end portion (stapling position) of the sheet bundle by means of the head assembly 31 and the anvil assembly 32. When the end portion (stapling positions) of the sheet bundle is stapled at a plurality of places, the staple sliding motor 42 is driven to shift the position of the stapler unit 30 before applying the stapling. The stapling/folding motor and the stapler sliding motor (not shown) are the sources of the power, or a part of the driving means, for moving the stapler unit 30 toward the sheet bundle, so that the staples can be applied to the places marked with the toner on each sheet of the sheet bundle.

Upon completion of the stapling process, the stepping motor 70 drives the underside transfer roller 18, the upside transfer roller 19, and the transfer belt 12 toward the tray with lift 90. Accordingly, the transfer of the stapled sheet bundle is relayed from the pair of the underside transfer roller 18 and the upside transfer roller 19 to the pushing claw 13. The pushing claw 13 pushes the sheet bundle to be loaded on the tray with lift 90. The operation of the tray with lift 90 in the later stage is omitted, since they are similar to those in the non-stapling mode.

(3) Center Stapling and Folding Mode

When the center stapling and folding mode is selected, similarly to the end-stapling mode, the sheets ejected from the digital copying machine 1 are loaded on the processing tray 8. After the sheet bundle is loaded and aligned on the processing tray 8, the upside transfer roller 19 descends toward the underside transfer roller 18 to hold the sheet bundle. The solenoid is turned off, and the stopper 21 is located at the retracted position.

The stepping motor 70 is driven in the direction inverse to the direction of the rotation in the non-stapling mode, and the sheet bundle nipped between the upside transfer roller 19 and the underside transfer roller 18 is transferred toward the stapler unit 30. Under this state, the head assembly 31 and the anvil assembly 32 remain at the initial position intersecting the transfer direction of the sheet bundle.

During the transfer of the sheet bundle, when the sheet end detection sensor 45 detects the end of the sheet in the transfer direction, the controller 149 stops the stepping motor 70 at the point where the middle of the sheet has arrived at the stapling point on the basis of the information concerning the length of the sheet previously received from the copying machine 1 and stored in the RAM.

The stapling/folding motor (not shown) for driving the head drive shaft 38 and the anvil drive shaft 37 is driven in the direction for the stapling operation. When a plurality of places are stapled, the stapler sliding motor 42 is driven to rotate the guide screw shafts 35 and 36, so that the head assembly 31 and the anvil assembly 32 are shifted to the predetermined positions in the direction intersecting the transfer direction of the sheet before the stapling operation takes place. When the sheet bundle is transferred to the stapling position, the front end of the sheet bundle in the transfer direction passes a point where the underside transfer roller 52 and the upside transfer roller 51 are separated from each other within the folding unit 50.

For the folding operation, the transfer motor (not shown) is inversely driven for rotating a transfer cam (not shown), so that the upside transfer roller 51 descends toward the underside transfer roller 52 to nip the sheet bundle. Then, the upside transfer roller 19 returns to the separated position to release the sheet bundle from the nipped position.

The drive motor (not shown) is driven to rotate the upside transfer roller 51 and the underside transfer roller 52 to transfer the sheet bundle toward a further downstream side. During this transfer operation, the controller 149 gradually decelerate transfer motor (not shown) to be stopped, so that the center of the sheet in the transfer direction, i.e., the stapling position, coincides with the folding position with reference to the detection signal from the end detection sensor 45 and the sheet length data stored in the RAM. At this point, the sheet bundle is nipped between the upside sheet bundle transfer roller 51 and the underside sheet bundle transfer roller 52 with the front end thereof hanging downwardly in the sheet bundle passage 58 (see FIG. 3).

The stapling/folding motor (not shown) rotates in the direction for the folding operation, that is, in the direction reverse to the direction for the stapling operation. Accordingly, the folding rollers 57*a* and 57*b* rotate in the directions for nipping the sheet bundle, while the pushing plate 55 descends, so that the folding rollers 57*a* and 57*b* abut against each other. Together with the descending motion, the backup guides 59*a* and 59*b* move so as to provide a space round the circumferential surfaces of the folding rollers on the side of the sheet bundle. When the pushing plate 55 descends, the sheet bundle is drawn between the folding rollers 57*a* and 57*b*, and the pushing plate 55 moves away from the sheet bundle, while the sheet bundle is further drawn between the folding rollers 57*a* and 57*b* to be transferred further in the nipped condition.

The sheet bundle transferred while being nipped between the folding rollers 57*a* and 57*b* is ejected onto the folded sheet bundle ejection stacker 80 to be stocked thereon. In this case, the folded sheet bundle (book) is held down by the folded sheet bundle hold-down member 81, so that the folded sheet bundle is prevented from opening to disturb folding the next sheet bundle into a book.

After the folding operation, when a pushing plate HP sensor (not shown) detects that the pushing plate 55 moves reciprocally the predetermined number of times depending on the length of the sheet in the transfer direction of the sheet bundle, the controller 149 stops the stapling/folding motor (not shown). When the time required from the start of the folding operation to the nipping of the sheet bundle between the folding rollers 57*a* and 57*b* has passed, the upside sheet bundle transfer roller 51 ascends away from the underside sheet bundle transfer roller 52 for receiving the next sheet bundle.

For the sheet bundle folding operation, the timing for folding the sheet (bundle) by the folding rollers 57*a* and 57*b* is set so as not coincide with the timing for the movement of the pushing plate 55, so that the pushing plate 55, after pushing the sheet bundle into between the folding roller 57*a* and the folding roller 57*b*, does not contact the both ends of the folded sheet bundle when returned to the pushing position during the sheet bundle folding operation. Accordingly, when the stapling/folding motor (not shown) drives the pushing plate 55 and the folding rollers 57*a* and 57*b* as a common power source, any damage to the sheet bundle can be prevented, thereby reducing a size and weight of the sheet processing unit 2.

An effect of the digital copying machine 1 according to the present invention will be described next.

Figure 10:
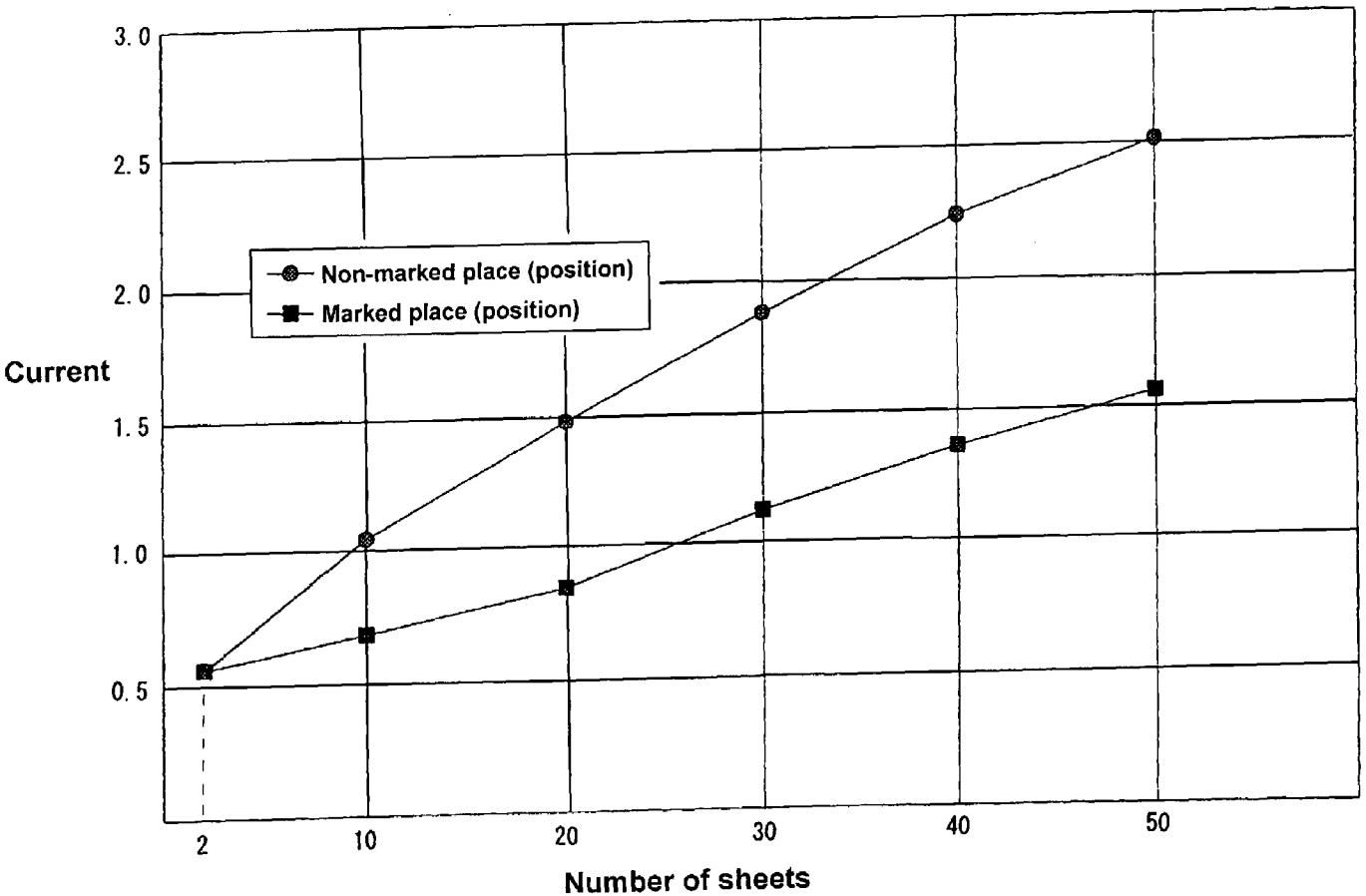
FIG. 10 is a graph showing a load of the stapler unit, wherein the horizontal axis represents the number of sheets in a sheet bundle and the vertical axis represents a current value upon stapling operation.

According to the present embodiment, the digital copying machine 1A performs the toner-mark-basis stapling process. FIG. 10 is a graph showing a load on the staple, wherein the horizontal axis represents the number of the sheets of the sheet bundle, while the vertical axis represents a current flowing in the stapler unit 50 during the stapling operation, i.e., a load on the stapler unit 50 or a load on the staple. As shown in FIG. 10, regardless of the front or the backside of the sheet, when the staple is driven into the place of the sheet marked with the toner (place marked with the toner), the current is smaller than that of a case that the staple is driven into a white sheet or into an unmarked place of the sheet. The current increases in proportion to the number of the sheets constituting the sheet bundle in both cases.

For instance, when driving the staple into the toner-marked place of a 50-sheet bundle, the current flowing in the stapler unit 50 is smaller than that required when driving the staple into the non-toner-marked place of a 30-sheet bundle. It is also found that the current required when driving the staple into place without the toner mark on the 20-sheet bundle is almost equal to that required when driving the staple into the toner-marked place of the 50-sheet bundle. When the number of the sheets contained in the bundle is constant, the load on the staple driven into the place marked with the toner is smaller than the load on the staple to be driven into the place not marked with the toner. Accordingly, it is possible to prevent deformation of the stapler and reduce a size of the stapler unit 50.

An exact reason for this phenomenon is not clarified yet. It can be considered that this phenomenon may result from gaps between the sheets with the toner images. The digital copying machine 1A of the present embodiment utilizes the above-mentioned principle, wherein the toner-mark-basis stapling principle is applied to increase the number of the sheets that can be stapled surely with one stapling action without the deformation of the staple.

If the toner mark is provided on a surface whereon the original image is formed, the toner mark becomes visible, thereby spoiling appearance of the sheet with the image. In the present embodiment, the toner mark is provided on the backside of the sheet, thereby maintaining appearance of the top surface of the sheet. As shown in FIG. 9(*a*) through FIG. 11(*c*), the size of the toner mark can be limited to the spots corresponding to the legs of the staple, thereby eliminating the negative effect on the appearance of the sheet with the image and reducing an amount of toner.

In the present embodiment, the uniform sheet size and uniform procedure for determining the stapling conditions according to the predetermined table have been described. Such stapling conditions may be modified by incorporating a function controllable by the operator. Thus, by incorporating such an adjusting function, the stapling process of the present invention can be applicable to a case where an image needs to be provided over the stapled place.

In the present embodiment, the digital copying machine 1 incorporates the hard disk 961, and the image data stored in the hard disk 961 may be utilized. More specifically, the hard disk 961 stores the image data already outputted from the personal computer 210 or the image data obtained by reading out the original data D from the image input unit 200. When the image data is outputted from the personal computer 210, the CPU needs an ID for enabling such data to be inputted to a folder thereof by means of a ten key or the like, and such a folder is provided with a name of the ID. In the latter case, an inquiry for the image data needs to be stored in the touch panel 248 or needs to be deleted by the operator through the touch panel display controller 250. Accordingly, when the operator wants to have such image data stored as it is, the operator will be required to input the ID for inputting such image data to the folder designed for storing collectively. Thus, where the ID has been inputted through the touch panel 210 or through the computer 210, it is necessary to check if the image data is stored collectively in the folder corresponding to the ID stored. When the response is affirmative, the image data stored in the folder is read out, and when the response is negative, the original image D may be read out through the automatic original image output unit 940. Accordingly, utilizing the image data stored in the hard disk 961 enables the operator to save time and labor for reading out the original data D for a large number of sheet bundles.

In the present embodiment, the sheet bundles are made by accumulating and loading the sheets in the sheet bundle making unit 20, and the present invention is not limited to such a case. For example, the sheet bundle making unit may hold and align the sheets vertically for making the sheet bundle.

In the present embodiment, the head assembly 31 and the anvil assembly 32 constituting the stapler unit 30 move toward the sheet bundle. The system may be reversed so that the sheet bundle moves toward the stapler unit 30. The system may be changed so that both the sheet bundle and the stapler unit 30 move toward each other. In such a case, both (the sheet bundle and the stapler unit 30) move toward each other, thereby shortening time for the stapler unit 30 to arrive at the stapling position.

In the present embodiment, the stapling position is specified through the controller 950 of the digital copying machine 1 in the step 304, and the present invention is not limited to this embodiment. For instance, the stapling position may be specified through the controller 149 of the sheet finishing apparatus 2, while the toner marking place may be inputted to the controller 950.

Further, as shown in FIG. 9(*a*) to FIG. 11(*c*), in the present embodiment, the toner mark is provided only at the positions immediately under the legs of the staple. As shown in FIG. 11(*a*), when the toner mark is formed in a strip shape continuously covering between the stapling positions, it is unnecessary to strictly specify the stapling positions on the sheet, thereby reducing the number of the sensors and eliminating the position specifying device. As shown in FIG. 11(*b*), when the toner marks are provided separately from each other corresponding to the separate stapling positions, it is not necessary to accurately specify the stapling positions by enlarging a size of the toner mark. Accordingly, even if the accuracy of the components of the sheet finishing apparatus 2 is low to some extent, the stapling operation can be accomplished surely without the deformation of the staple.

The disclosure of Japanese Patent Application No. 2003-404863, filed on Dec. 3, 2003, is incorporated in the application.

While the invention has been explained with reference to the specific embodiments of the invention, the explanation is illustrative and the invention is limited only by the appended claims.

What is claimed is:

1. A sheet finishing apparatus comprising:

a transfer device for transferring sheets having toner marks for stapling thereon, a sheet bundling device for bundling the sheets transferred from the transfer device, and a stapling device for driving a staple into the sheets at positions where the toner marks are formed to staple the sheets, said stapling device being arranged to drive the staple from backsides of the sheets opposite to surfaces where the toner marks are formed so that the staple passes through the toner marks.

2. A sheet finishing apparatus comprising:

a transfer device for transferring sheets having toner marks for stapling thereon, a sheet bundling device for bundling the sheets transferred from the transfer device, a stapling device for driving a staple into the sheets at positions where the toner marks are formed to staple the sheets, a transport device for moving at least one of the bundled sheets and the stapling device relative to each other, and a control device for controlling the transport device so that the stapling device drives the staple into the sheets at the positions where the toner marks are formed, said staple passing through the toner marks.

3. A sheet finishing apparatus according to claim 2, wherein said stapling device drives the staple from backsides of the sheets opposite to surfaces where the toner marks are formed.

4. An image forming apparatus comprising;

a sheet feeding device for feeding sheets, an image forming device for forming toner marks for stapling on the sheets fed from the sheet feeding device, a sheet transfer device for transferring the sheets having the toner marks, a sheet bundling device for bundling the sheets transferred from the transfer device, and a stapling device for stapling the sheets at positions where the toner marks are formed so that staple passes through the toner marks.

5. An image forming apparatus according to claim 4, further comprising a positioning device for determining a stapling position, and an image control device for controlling the image forming device to form the toner marks at the positions including the stapling positions.

6. An image forming apparatus according to claim 5, wherein said image control device controls the image forming apparatus to separately form the toner marks at positions corresponding to the stapling positions when the positioning device determines a plurality of the stapling positions.

7. An image forming apparatus according to claim 5, wherein said image control device controls the image forming device to form the toner marks separately at positions corresponding to ends of the staple.

8. An image forming apparatus according to claim 5, wherein said image control device controls the image forming device to form the toner mark on a front side of the sheet opposite to a surface where the stapling device drives the staple, and the stapling device drives the staple at a rear side where the toner mark is formed.

9. An image forming apparatus according to claim 5, further comprising a transport device for moving at least one of the bundled sheets and the stapling device relative to each other, and a control device for controlling the transport device so that the stapling device drives the staple into the sheets at the positions where the toner marks are formed.

10. An image forming apparatus according to claim 9, further comprising a positioning device for determining a stapling position, and an image control device for controlling the image forming device to form the toner marks at the positions including the stapling position.

11. An image forming apparatus according to claim 10, wherein said image control device controls the image forming apparatus to separately form the toner marks at positions corresponding to the stapling positions when the positioning device determines a plurality of the stapling positions.

12. An image forming apparatus according to claim 10, wherein said image control device controls the image forming device to form the toner marks separately at positions corresponding to ends of the staple.

13. An image forming apparatus according to claim 10, wherein said image control device controls the image forming device to form the toner marks on a front side of the sheet opposite to a surface where the stapling device drives the staple, and the stapling device drives the staple at a rear side where the toner marks are formed.

14. An image forming apparatus according to claim 4, wherein said image forming device includes a duplex section for forming the toner marks on back sides of the sheets.

* * * * *